US010288058B2

(12) United States Patent
Howard et al.

(10) Patent No.: US 10,288,058 B2
(45) Date of Patent: May 14, 2019

(54) METHOD AND SYSTEM FOR AN INSTRUMENTED PISTON ASSEMBLY

(71) Applicant: General Electric Company, Schenectady, NY (US)

(72) Inventors: Brian Francis Howard, Issaquah, WA (US); Raymond Verle Jensen, Gardnerville, NV (US)

(73) Assignee: General Electric Company, Schenectady, NY (US)

( * ) Notice: Subject to any disclaimer, the term of this patent is extended or adjusted under 35 U.S.C. 154(b) by 951 days.

(21) Appl. No.: 14/496,831

(22) Filed: Sep. 25, 2014

(65) Prior Publication Data

US 2016/0090980 A1 Mar. 31, 2016

(51) Int. Cl.

| | |
|---|---|
| ***F04B 49/06*** | (2006.01) |
| ***F04B 39/00*** | (2006.01) |
| ***F04B 51/00*** | (2006.01) |
| ***F04B 53/14*** | (2006.01) |

(52) U.S. Cl.

CPC ..... *F04B 49/06* (2013.01); *F04B 39/0005* (2013.01); *F04B 51/00* (2013.01); *F04B 53/14* (2013.01)

(58) Field of Classification Search

CPC ..... B60C 23/04; F03G 7/08; H01L 41/00; H02N 2/00; H02J 17/04; F04B 49/06; F04B 39/0005; F04B 51/00; F04B 53/14

See application file for complete search history.

(56) References Cited

U.S. PATENT DOCUMENTS

| | | | | |
|---|---|---|---|---|
| 5,602,757 | A | 2/1997 | Haseley et al. | |
| 6,168,387 | B1 | 1/2001 | Able et al. | |
| 6,292,757 | B1 | 9/2001 | Flanagan et al. | |
| 7,056,097 | B2 | 6/2006 | Lake | |
| 7,141,988 | B2 | 11/2006 | Chertok | |
| 7,656,305 | B2 | 2/2010 | Kennedy | |
| 8,203,350 | B2 | 6/2012 | Hala et al. | |
| 8,348,628 | B2 | 1/2013 | Hala | |
| 2006/0259217 | A1* | 11/2006 | Gorinevsky | G05B 23/0283 702/184 |
| 2007/0075584 | A1* | 4/2007 | Moriya | H02J 1/14 307/9.1 |
| 2010/0293397 | A1 | 11/2010 | Pham et al. | |

(Continued)

FOREIGN PATENT DOCUMENTS

| | | | |
|---|---|---|---|
| CN | 102428277 | A | 4/2012 |
| CN | 102797671 | A | 11/2012 |

(Continued)

OTHER PUBLICATIONS

Translation of DE 102013202800.*

(Continued)

*Primary Examiner* — Hal Kaplan
*Assistant Examiner* — Elim Ortiz
(74) *Attorney, Agent, or Firm* — Mintz Levin Cohn Ferris Glovsky and Popeo, P.C.

(57) ABSTRACT

A system and method of monitoring operating parameters of a reciprocating compressor are provided. The system includes a piston head assembly including a piston head body, at least one sensor positioned within the piston head body, and an electrical power source positioned within the piston head body. The electrical power source is configured to provide electrical energy to the at least one sensor.

20 Claims, 6 Drawing Sheets

(56) References Cited

U.S. PATENT DOCUMENTS

| | | | | |
|---|---|---|---|---|
| 2011/0084503 | A1* | 4/2011 | Li | B60G 17/019 290/1 R |
| 2012/0134850 | A1 | 5/2012 | Grant et al. | |
| 2013/0071260 | A1 | 3/2013 | Worden et al. | |
| 2014/0174395 | A1* | 6/2014 | Richerson | F02F 3/00 123/193.6 |

FOREIGN PATENT DOCUMENTS

| | | | | |
|---|---|---|---|---|
| CN | 102913431 | A | 2/2013 | |
| CN | 103147972 | A | 6/2013 | |
| DE | 102009021717 | A1 | 11/2010 | |
| DE | 102013202800 | A1 * | 8/2014 | H01L 41/113 |
| EP | 0671618 | A1 | 9/1995 | |
| EP | 2012013 | A1 * | 1/2009 | F04B 51/00 |
| IN | 1620DEL2007 | | 2/2008 | |
| IN | 1816MUM2010 | | 10/2010 | |
| IN | 201103326 | I1 | 11/2011 | |
| JP | 2005189233 | A | 7/2005 | |
| KR | 1300433 | B1 | 8/2013 | |
| WO | 2005108744 | A1 | 11/2005 | |
| WO | 2006046937 | A1 | 5/2006 | |
| WO | 2012032222 | A1 | 3/2012 | |
| WO | 2013003800 | A1 | 1/2013 | |

OTHER PUBLICATIONS

European Search Report and Opinion issued in connection with corresponding EP Application No. 5186609.2 dated Feb. 22, 2016.
EP Office Action, dated Jul. 19, 2017, for co-pending EP patent application No. EP 15186609.2 (3 pgs).

* cited by examiner

METHOD AND SYSTEM FOR AN INSTRUMENTED PISTON ASSEMBLY

BACKGROUND

This description relates to reciprocating compressors and, more particularly, to methods and systems for use in monitoring operation of reciprocating compressors.

At least some known reciprocating compressors include a cylinder assembly that is coupled to a compressor frame and that includes a piston assembly that moves in a reciprocating motion within a cylinder head. Known piston assemblies compress a gas channeled within the cylinder head prior to discharging compressed gas to an output device.

At least some known reciprocating components in known compressors may be subjected to increased loads (e.g., asymmetric loads) that result from structural fatigue. Over time, the increased loading may contribute to increasing fatigue cycles on the cylinder assembly and/or other components of the reciprocating compressor, and may lead to premature failure of such components. Moreover, components that have not been properly installed may become loose during operation. In addition, known reciprocating compressors may be subjected to operational detriments from operating conditions, such as modulating pressure, vibrations, modulating temperatures, and general mechanical wear. The combination of the operational detriments and the increasing loading may induce stresses to the compressor that cause structural fatigue and/or failure, which may adversely impact performance of the reciprocating compressor.

At least some known methods for monitoring known reciprocating compressors require manual inspections of the compressor and associated components. Such inspections may be expensive and/or time-consuming. Known automatic monitoring systems provide significant benefits but are limited in their application. Pressure transducers provide valuable information in condition monitoring, but have always had to be installed outside the cylinder, which leaves the pressure transducer exposed to mechanical and environmental damage. Additionally, there have been a variety of attempts to measure rider band thickness. Retrofitting a reciprocating compressor with condition monitoring instrumentation is a costly and labor intensive undertaking.

BRIEF DESCRIPTION

In one embodiment, a piston head assembly includes a piston head body, at least one sensor positioned within the piston head body, and an electrical power source positioned within the piston head body, the electrical power source configured to provide electrical energy to the at least one sensor.

In another embodiment, a control system for a reciprocating compressor includes a plurality of sensors positioned within a piston head body of the reciprocating compressor, and a power supply positioned within the piston head body and configured to generate electrical power using forces acting on the piston head body, the power supply electrically coupled to the plurality of sensors In yet another embodiment, a method of monitoring operating parameters of a reciprocating compressor includes positioning one or more sensors within a piston head of the reciprocating compressor. The piston head is configured to translate axially along a cylinder bore. The one or more sensors are configured to measure operating parameters of the piston head. The one or more sensors are configured to measure operating parameters adjacent the piston head. The method also includes wirelessly communicating signals representing the measured operating parameters from onboard the piston head to a receiver positioned offboard the piston head, and generating electrical power onboard the piston head using forces acting on the piston head, the generated electrical power used to provide electrical power to electrical components positioned onboard the piston head.

BRIEF DESCRIPTION OF THE DRAWINGS

FIG. 1 is a schematic illustration of a reciprocating compressor including a condition monitoring system in accordance with an example embodiment of the present disclosure.

FIG. 2 is a cross-sectional view of the reciprocating compressor taken along a line 2-2.

FIG. 3 is a block diagram of the condition monitoring system shown in FIG. 1.

FIG. 4 is a block diagram of the protection system shown in FIG. 1.

FIG. 5 is a block diagram of a user computing device in accordance with an example embodiment of the present disclosure.

FIG. 6 is a cross-sectional view of the piston head shown in FIG. 1 in accordance with an example embodiment of the present disclosure.

FIG. 7 is a flowchart of a method of monitoring operating parameters of a reciprocating compressor.

Although specific features of various embodiments may be shown in some drawings and not in others, this is for convenience only. Any feature of any drawing may be referenced and/or claimed in combination with any feature of any other drawing.

Unless otherwise indicated, the drawings provided herein are meant to illustrate features of embodiments of the disclosure. These features are believed to be applicable in a wide variety of systems including one or more embodiments of the disclosure. As such, the drawings are not meant to include all conventional features known by those of ordinary skill in the art to be required for the practice of the embodiments disclosed herein.

DETAILED DESCRIPTION

The following detailed description illustrates embodiments of the disclosure by way of example and not by way of limitation. It is contemplated that the disclosure has general application to analytical and methodical embodiments of monitoring operation of reciprocating compressor and other machinery in industrial, commercial, and residential applications.

The exemplary methods and systems described herein overcome disadvantages of known monitoring systems by providing a condition monitoring system that facilitates monitoring the condition of known reciprocating compressors. In addition, the condition monitoring system enables the piston assembly and cylinder volume of the reciprocating compressor to be directly determined, while the compressor remains operating, based on a sensors mounted onboard the piston assembly. Moreover, the condition monitoring system enables the reciprocating compressor to shutdown after determining that the condition of the reciprocating compressor is different than a predefined condition.

This disclosure provides a method and apparatus to reduce the effort and risk of retrofitting condition monitoring sensors on a reciprocating compressor by modifying the pistons to include condition monitoring instrumentation including, but not limited to, a phase reference sensor, such as, but not limited to a Keyphasor®, cylinder pressure sensors, and piston position sensors.

The following description refers to the accompanying drawings, in which, in the absence of a contrary representation, the same numbers in different drawings represent similar elements.

Figure 1:
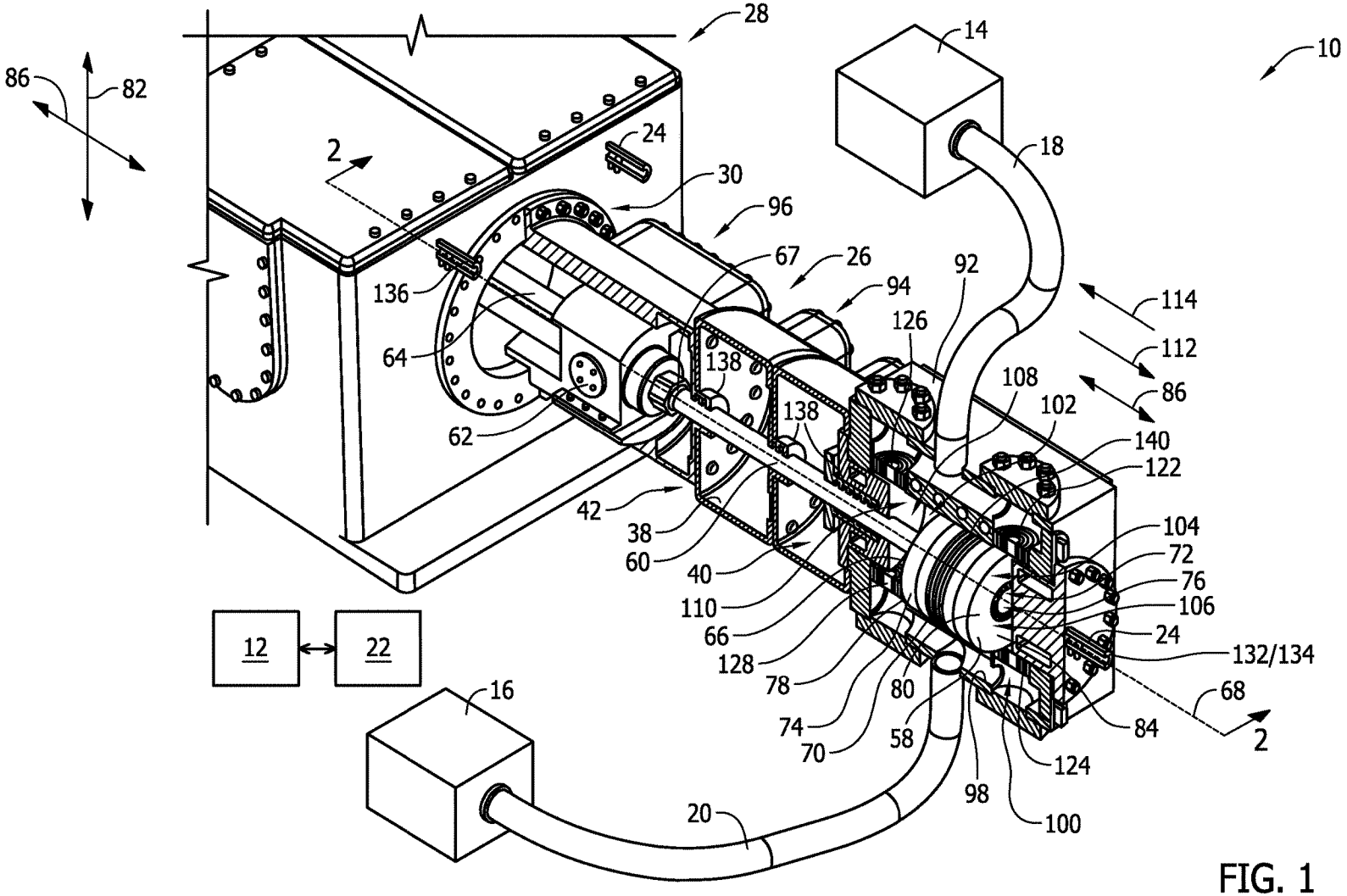
FIGS. 1-7 show example embodiments of the method and apparatus described herein.
Figure 2:
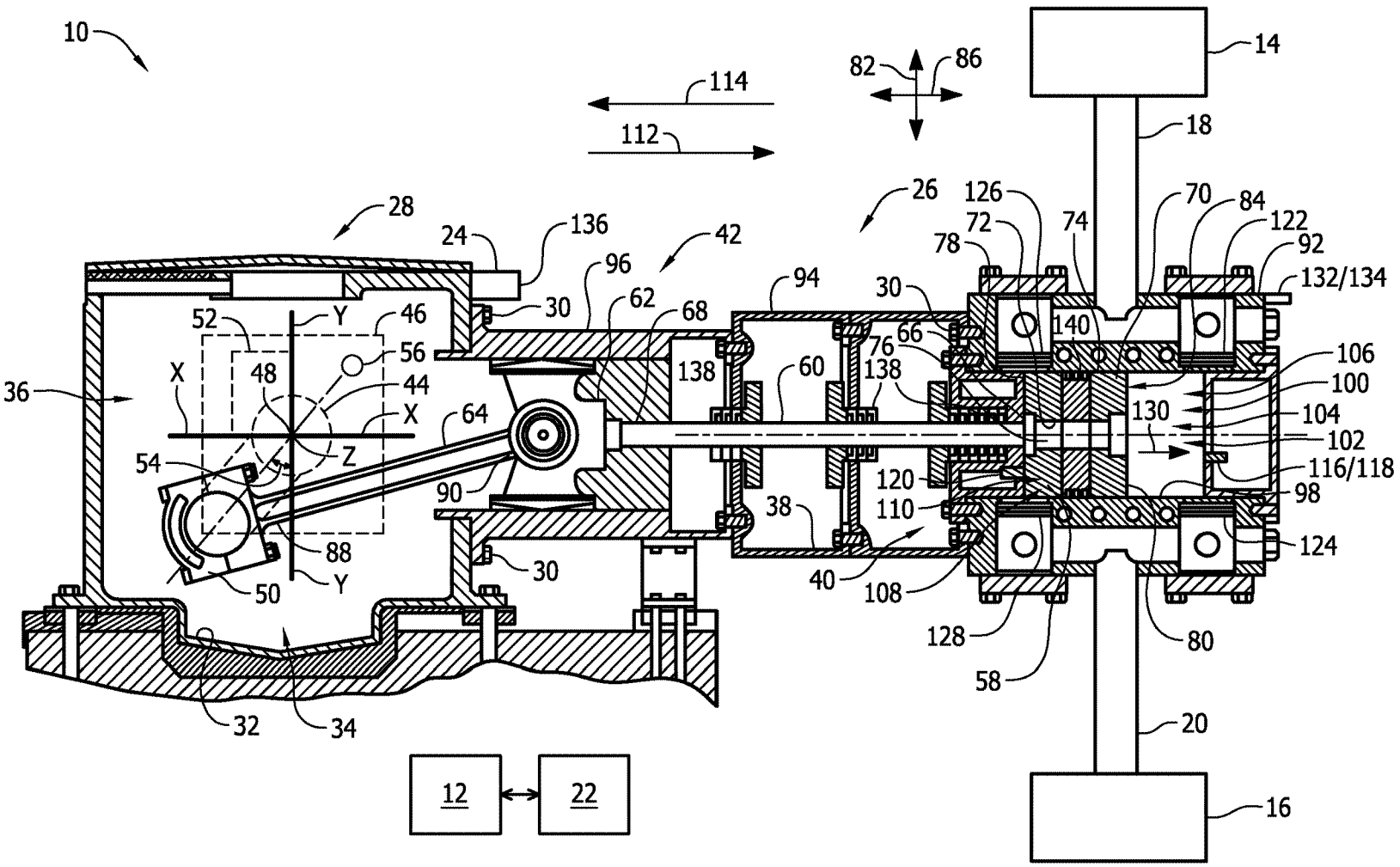

FIG. 1 is a schematic illustration of an exemplary reciprocating compressor 10 including a condition monitoring system 12. FIG. 2 is a cross-sectional view of reciprocating compressor 10 taken along line 2-2. In the exemplary embodiment, reciprocating compressor 10 is coupled in flow communication between a gas source 14 and an output assembly 16. Reciprocating compressor 10 receives a flow of fluid such as, for example a gas or a gas mixture, compresses the gas to a higher pressure and a lower volume, and discharges the compressed gas to output assembly 16. In the exemplary embodiment, one or more fluid inlet conduits 18 are coupled between gas source 14 and reciprocating compressor 10 for channeling gas from gas source 14 to reciprocating compressor 10. Moreover, one or more fluid outlet conduits 20 are coupled between reciprocating compressor 10 and output assembly 16 for channeling compressed gas from reciprocating compressor 10 to output assembly 16.

In the exemplary embodiment, condition monitoring system 12 is coupled to reciprocating compressor 10 for monitoring reciprocating compressor 10. More specifically, condition monitoring system 12 is coupled to reciprocating compressor 10 to enable monitoring of forces acting on the piston, piston position, and cylinder pressure on the head end and crank end. Condition monitoring system 12 includes a protection system 22 that is coupled in communication with a plurality of sensors 24 (communication conduits not shown for clarity). Each sensor 24 detects various conditions of reciprocating compressor 10. Sensors 24 may include, but are not limited to only including, position sensors, temperature sensors, flow sensors, acceleration sensors, pressure sensors and/or any other sensors that sense various parameters relative to the operation of reciprocating compressor 10. As used herein, the term "parameters" refers to physical properties whose values can be used to define the operating conditions of reciprocating compressor 10, such as vibrations, pressures, and fluid flows at defined locations.

In the exemplary embodiment, reciprocating compressor 10 includes at least one cylinder assembly 26 that is coupled to a compressor frame 28. A plurality of fastener assemblies 30 couple cylinder assembly 26 to compressor frame 28. In the exemplary embodiment, compressor frame 28 includes an inner surface 32 that defines a cavity 34 therein. A crankshaft assembly 36 coupled to compressor frame 28 is positioned within cavity 34. Cylinder assembly 26 extends outwardly from compressor frame 28 and includes an inner surface 38 that defines a cylinder cavity 40. A piston assembly 42 is positioned within cylinder cavity 40 and is coupled to crankshaft assembly 36. Crankshaft assembly 36 includes a crankshaft 44 that is rotatably coupled to a motor 46. Motor 46 is configured to rotate crankshaft 44 about an axis of rotation 48 and protection system 22 controls an operation of motor 46.

In the exemplary embodiment, crankshaft 44 includes at least one crank pin 50 that extends substantially radially outwardly from crankshaft 44. More specifically, in the exemplary embodiment, three perpendicular axes X, Y, and Z extend through crankshaft 44 to define a three-dimensional Cartesian coordinate system relative to crankshaft 44 such that the Z-axis is substantially coaxial with axis of rotation 48, and such that the X-axis and the Y-axis intersect to form a rotational plane 52 of crank pin 50. A crank angle $\alpha$ is defined between crank pin 50 and Y-axis. Crankshaft 44 is configured to rotate crank pin 50 about axis 48 between a crank angle $\alpha$ of about 0° to about 360°. At least one position sensor 56 is coupled to compressor frame 28 for sensing a position of crank pin 50 with respect to Y-axis and for transmitting a signal indicative of the sensed position to protection system 22. In one embodiment, position sensor 56 includes a multi-event wheel for use in sensing a position of crank pin 50 with respect to Y-axis.

In the exemplary embodiment, piston assembly 42 includes a piston head 58, a piston rod 60 that is coupled to piston head 58, a crosshead 62 that is coupled to piston rod 60, and a connecting rod 64 that is coupled between crosshead 62 and crank pin 50. Piston rod 60 includes a centerline axis 68 that extends from a first end 66 to a second end 67. Piston assembly 42 is coupled to crankshaft assembly 36 such that axis of rotation 48 is oriented substantially perpendicular to centerline axis 68. Piston head 58 includes an annular piston head body 70 that includes a radially inner surface 72 and a radially outer surface 74. Radially inner surface 72 defines an inner cylindrical cavity 76 that extends generally axially through piston head body 70 along centerline axis 68. Inner cylindrical cavity 76 is substantially cylindrical in shape and is sized to receive piston rod 60 therein. Piston head 58 also includes a crank end surface 78 and an opposite head end surface 80. Crank end surface 78 is positioned closer to crankshaft 44 than head end surface 80. Each end surface 78 and 80 extends generally radially between radially inner surface 72 and radially outer surface 74 in a direction that is that is generally perpendicular to centerline axis 68. Each end surface 78 and 80 includes a working surface area 84 that extends between surface 72 and surface 74.

In the exemplary embodiment, piston assembly 42 translates a rotation of crankshaft 44 about axis 48 into a linear movement of piston head 58 along centerline axis 68. Piston rod 60 is coupled between crosshead 62 and piston head 58, and is oriented to move piston head 58 along centerline axis 68. Connecting rod 64 extends between crosshead 62 and crank pin 50 and includes a first end 88 and a second end 90. First end 88 is coupled to crank pin 50 and is pivotable with respect to crank pin 50, as crank pin 50 rotates about axis 48. Second end 90 is coupled to crosshead 62 and is pivotable with respect to crosshead 62. During operation, as crankshaft 44 rotates about axis 48, connecting rod 64 pivots with respect to crosshead 62 and moves crosshead 62 along centerline axis 68. Crosshead 62, in turn, moves piston rod 60 and piston head 58 longitudinally along centerline axis 68. As crankshaft 44 is rotated through a full rotation from crank angle $\alpha$ from 0° to 360°, piston head 58 is reciprocated along centerline axis 68. A complete compressor operation cycle of reciprocating compressor 10 includes a full rotation between crank angle $\alpha$ of 0° to 360°.

In the exemplary embodiment, cylinder assembly 26 includes a cylinder head 92, a distance piece 94, and a crosshead guide 96. Fastener assemblies 30 are coupled between cylinder head 92, distance piece 94, and crosshead guide 96 to facilitate coupling cylinder head 92, distance piece 94, and crosshead guide 96 together. Distance piece 94 extends between cylinder head 92 and crosshead guide 96. Crosshead guide 96 is coupled to compressor frame 28 for supporting cylinder assembly 26 from compressor frame 28. Cylinder head 92 includes an inner surface 98 that defines a cavity 100. Piston head 58 is positioned within, and is movable within, cavity 100 along centerline axis 68. Head end surface 80 at least partially defines a first chamber 104, i.e. a head end (HE) chamber that extends between head end surface 80 and inner surface 98. Crank end surface 78 defines a second chamber 108, i.e. a crank end (CE) chamber that extends between crank end surface 78 and inner surface 98. Piston rod 60 extends outwardly from piston head 58 and is positioned with distance piece 94. Crosshead 62 is coupled to piston rod 60 and is positioned within crosshead guide 96.

In the exemplary embodiment, piston assembly 42 is moveable in a reciprocating motion along centerline axis 68 between a compression stroke 112 (represented by an arrow), and a tension stroke 114 (represented by an arrow). During compression stroke 112, piston head 58 moves outwardly from crankshaft 44 such that HE chamber 104, i.e. an HE volume, is reduced and such that chamber 108, i.e. a CE volume, is increased. During tension stroke 114, piston head 58 moves inwardly towards crankshaft 44 such that the HE chamber volume is increased and such that CE chamber volume is reduced. At least one pressure sensor 116 is coupled to cylinder assembly 26 for use in sensing a pressure within HE chamber 104 and/or CE chamber 108. Pressure sensor 116 transmits a signal indicative of fluid pressure to protection system 22. In the exemplary embodiment, condition monitoring system 12 includes a first pressure sensor 118 and a second pressure sensor 120. First pressure sensor 118 is coupled to HE chamber 104 for sensing a pressure within HE chamber 104, and second pressure sensor 120 is coupled to CE chamber 108 for sensing a pressure within CE chamber 108.

In the exemplary embodiment, cylinder head 92 includes an HE suction valve 122 and a HE discharge valve 124. HE suction valve 122 is coupled in flow communication between HE chamber 104 and fluid inlet conduit 18 for regulating a flow of gas from gas source 14 to HE chamber 104. HE suction valve 122 is movable between an open position that enables gas to be channeled from gas source 14 to HE chamber 104, and a closed position that prevents gas from being channeled from gas source 14 to HE chamber 104. HE discharge valve 124 is coupled in flow communication between HE chamber 104 and fluid outlet conduit 20 for regulating a flow of compressed gas from HE chamber 104 to output assembly 16. HE discharge valve 124 is movable between an open position that enables gas to be discharged from HE chamber 104 to output assembly 16 and a closed position that prevents gas from being discharged from HE chamber 104 to output assembly 16. HE suction valve 122 moves to the open position when a pressure within HE chamber 104 is at a first predefined pressure, and moves to the closed position when the pressure within HE chamber 104 is above the first pressure. HE discharge valve moves to the open position when the pressure within HE chamber is at a second predefined pressure that is higher than the first pressure, and moves to the closed position when the pressure is below the second pressure.

Cylinder head 92 also includes a CE suction valve 126 and a CE discharge valve 128. CE suction valve 126 is coupled in flow communication between CE chamber 108 and fluid inlet conduit 18 for regulating a flow of gas from gas source 14 to CE chamber 108. CE suction valve 126 is movable between an open position that enables gas to be channeled from gas source 14 to CE chamber 108 and a closed position that prevents gas from being channeled from gas source 14 to CE chamber 108. CE discharge valve 128 is coupled in flow communication between CE chamber 108 and fluid outlet conduit 20 for regulating a flow of compressed gas from CE chamber 108 to output assembly 16. CE discharge valve 128 is movable between an open position that enables gas to be discharged from CE chamber 108 to output assembly 16 and a closed position that prevents gas from being discharged from CE chamber 108 to output assembly 16. CE suction valve 126 moves to the open position when a pressure within CE chamber 108 is at a third predefined pressure, and moves to the closed position when the pressure within CE chamber 108 is above the third pressure. CE discharge valve 128 moves to the open position when the pressure within CE chamber 108 is at a fourth predefined pressure that is greater than the third pressure, and moves to the closed position when the pressure within CE chamber 108 is below the fourth pressure.

During operation of reciprocating compressor 10, HE suction valve 122 and HE discharge valve 124 are operated to maintain a pressure within HE chamber 104 between the first and second pressures. As piston assembly 42 moves through tension stroke 114, HE suction valve 122 and HE discharge valve are closed such that pressure within HE chamber 104 is reduced from the second pressure to the first pressure as the HE chamber volume is increased. At the first pressure, HE suction valve 122 moves to the open position to enable a flow of gas to be channeled into HE chamber 104 from gas source 14. As gas is channeled into HE chamber 104, piston assembly 42 moves through tension stroke 114 towards a first rod reversal event. During the first rod reversal event, piston assembly 42 reverses direction along centerline axis 68 from tension stroke 114 to compression stroke 112. During compression stroke 112, pressure within HE chamber 104 is increased from the first pressure to the second pressure. As the pressure within HE chamber 104 is increased above the first pressure, HE suction valve 122 moves to the closed position to prevent gas from being channeled from gas source 14 to HE chamber 104. During compression stroke 112, the HE chamber volume is reduced to facilitate compressing gas within HE chamber 104. At second pressure, HE discharge valve 124 moves to the open position to enable compressed gas to be discharged from HE chamber 104 to output assembly 16 as piston assembly 42 moves through compression stroke 112 towards a second rod reversal event. During the second rod reversal event, piston assembly 42 reverses direction along centerline axis 68 from compression stroke 112 to tension stroke 114.

Similarly, CE suction valve 126 and CE discharge valve 128 are operated to maintain a pressure within CE chamber 108 between the third and fourth pressures. As piston assembly 42 moves through compression stroke 112, CE suction valve 126 and CE discharge valve 128 are closed such that pressure within CE chamber 108 is reduced from the fourth pressure to the third pressure. At the third pressure, CE suction valve 126 is opened to enable a flow of gas to be channeled into CE chamber 108 from gas source 14. As piston assembly 42 moves through the first rod reversal event to tension stroke 114, pressure within CE chamber 108 is increased from the third pressure to the fourth pressure. As the pressure within CE chamber 108 is increased above the third pressure, CE suction valve 126 is closed to prevent gas from being channeled from gas source 14 to CE chamber 108, and to enable piston head 58 to compress gas within CE chamber 108. At fourth pressure, CE discharge valve 128 is opened to enable compressed gas to be discharged from CE chamber 108 to output assembly 16 as piston assembly 42 moves towards the second rod reversal event.

Moreover, during operation of reciprocating compressor 10, as piston head 58 compresses gas within HE chamber 104, the compressed gas imparts a gas force, represented by arrow 130, against cylinder head 92. As used herein, the term "gas force" refers to an amount of force applied against cylinder head 92 by gas when piston head 58 is compressing the gas within HE chamber 104 and/or CE chamber 108. Gas force 130 acting upon cylinder head 92 is approximately equal to the sum of the gas force acting upon crank end surface 78 of piston head 58 and the gas force acting upon the head end surface 80 of piston head 58. The gas force acting on the head end surface 80 is approximately equal to working surface area 84 of head end surface 80 multiplied by the pressure within HE chamber 104. The gas force acting upon crank end surface 78 of piston head 58 is equal to working surface area 84 of crank end surface 78 multiplied by the pressure within CE chamber 108.

During operation, reciprocating compressor 10, cylinder assembly 26 and compressor frame 28 are subjected to various forces, i.e. gas compression loads and/or rotational loads that cause cylinder assembly 26 and compressor frame 28 to oscillate and/or generate a vibration. More specifically, as piston assembly 42 is moved through a compression stroke 112 and a tension stroke 114, cylinder assembly 26 and compressor frame 28 oscillate along centerline axis 68. Over time, the oscillations and/or vibrations may increase mechanical wear in cylinder assembly 26, compressor frame 28, and/or fastener assemblies 30. During normal operation, reciprocating compressor 10 generally operates within a predefined range of displacement values, based on structural characteristics of cylinder assembly 26 and compressor frame 28. Over time, as reciprocating compressor 10 is subjected to general mechanical wear, fastener assemblies 30 may become loose and/or structural fatigue may develop within fastener assemblies 30. Such fatigue may cause reciprocating compressor 10 to operate with displacement values that are not within the predefined range of displacement values. In addition, the wear of seals 138 and rings 140 may cause leakage and instability in the travel of the piston in the cylinder. Condition monitoring system 12 is configured to monitor the process parameter values of reciprocating compressor 10 and to notify an operator when reciprocating compressor 10 is not operating within a predefined range of values. In one embodiment, condition monitoring system 12 operates motor 46 to modulate a rotational velocity of crankshaft 44 and/or shut-down an operation of reciprocating compressor 10 when a monitored parameter is different than a predefined value for that parameter.

In the exemplary embodiment, condition monitoring system 12 includes at least one vibration sensor 132 that is coupled to cylinder assembly 26 for sensing a displacement of cylinder assembly 26 along centerline axis 68. In the exemplary embodiment, condition monitoring system 12 includes a first vibration sensor 134 and a second vibration sensor 136. First vibration sensor 134 is coupled to cylinder assembly 26 for sensing seismic acceleration of reciprocating compressor 10 and for transmitting a signal indicative of the sensed acceleration to protection system 22. In this embodiment, first vibration sensor 134 senses an acceleration of reciprocating compressor 10 along centerline axis 68. Second vibration sensor 136 is coupled to compressor frame 28 for sensing seismic acceleration of compressor frame 28 and for transmitting a signal indicative of the sensed acceleration to protection system 22. Second vibration sensor 136 senses an acceleration of compressor frame 28 along centerline axis 68.

Figure 3:
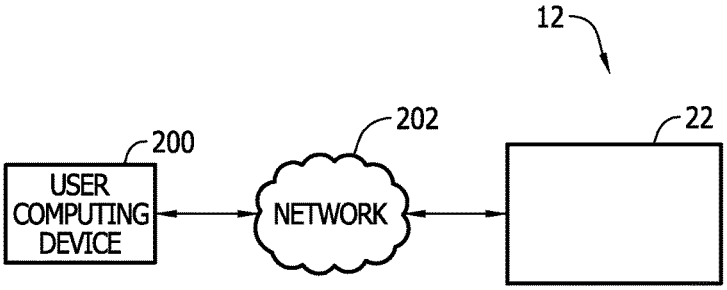

FIG. 3 is a block diagram of condition monitoring system 12. In the exemplary embodiment, condition monitoring system 12 includes a user computing device 200 that is coupled to protection system 22 via a network 202. Network 202 may include, but is not limited to, the Internet, a local area network (LAN), a wide area network (WAN), a wireless LAN (WLAN), a mesh network, and/or a virtual private network (VPN). User computing device 200 and protection system 22 communicate with each other and/or network 202 using a wired network connection (e.g., Ethernet or an optical fiber), a wireless communication means, such as radio frequency (RF), an Institute of Electrical and Electronics Engineers (IEEE) 802.11 standard (e.g., 802.11(g) or 802.11(n)), the Worldwide Interoperability for Microwave Access (WIMAX) standard, a cellular phone technology (e.g., the Global Standard for Mobile communication (GSM)), a satellite communication link, and/or any other suitable communication means. WIMAX is a registered trademark of WiMax Forum, of Beaverton, Oreg. IEEE is a registered trademark of Institute of Electrical and Electronics Engineers, Inc., of New York, N.Y.

Figure 4:
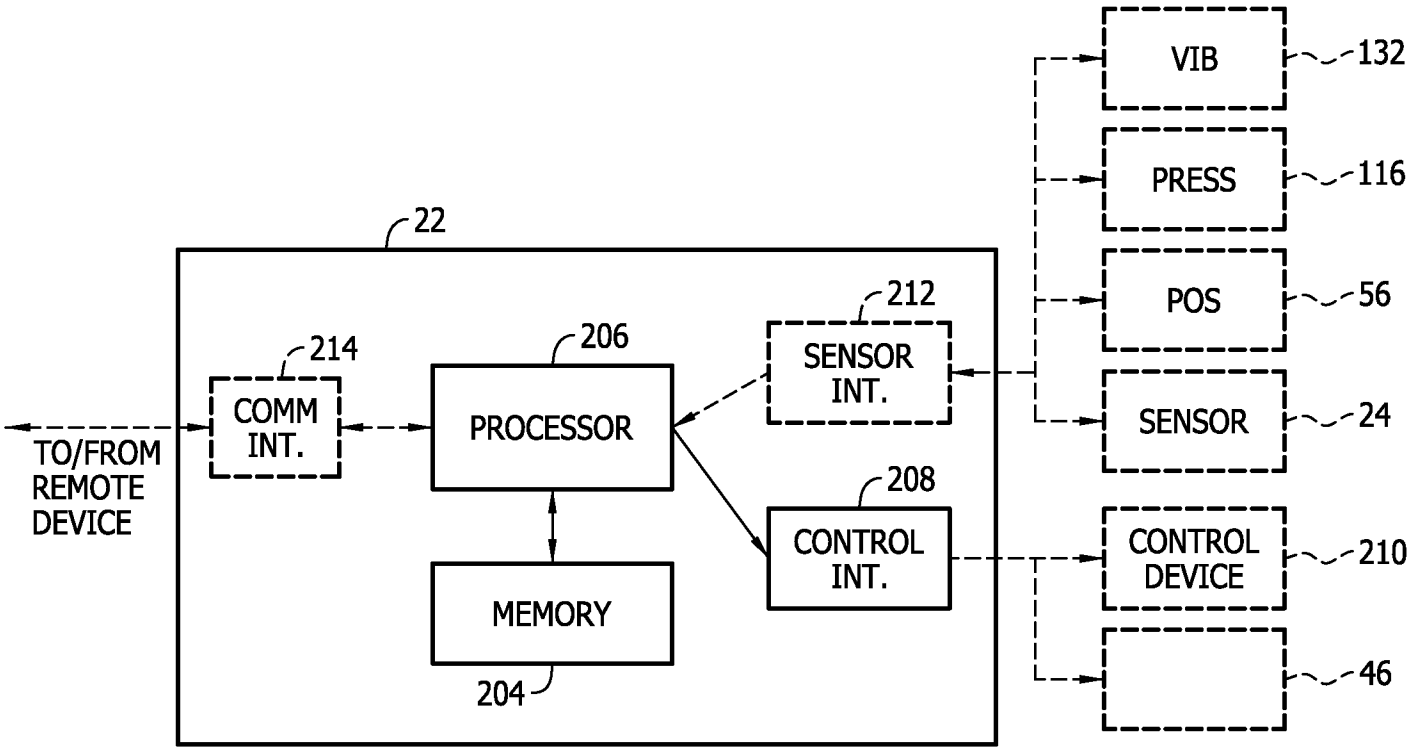

FIG. 4 is a block diagram of protection system 22. In the exemplary embodiment, protection system 22 is a real-time controller that includes any suitable processor-based or microprocessor-based system, such as a computer system, that includes microcontrollers, reduced instruction set circuits (RISC), application-specific integrated circuits (ASICs), logic circuits, and/or any other circuit or processor that is capable of executing the functions described herein. In one embodiment, protection system 22 may be a microprocessor that includes read-only memory (ROM) and/or random access memory (RAM), such as, for example, a 32 bit microcomputer with 2 Mbit ROM and 64 Kbit RAM. As used herein, the term "real-time" refers to outcomes occurring at a substantially short period of time after a change in the inputs affect the outcome, with the time period being a design parameter that may be selected based on the importance of the outcome and/or the capability of the system processing the inputs to generate the outcome.

In the exemplary embodiment, protection system 22 includes a memory area 204 that stores executable instructions and/or one or more operating parameters representing and/or indicating an operating condition of reciprocating compressor 10. Operating parameters may represent and/or indicate, without limitation, a vibration frequency, a fluid pressure, a rotational position, and/or a displacement. In one embodiment, memory area 204 stores a predefined range of operating parameter values that are received from user computing device 200. In the exemplary embodiment, protection system 22 also includes a processor 206 that is coupled to memory area 204 and that is programmed to calculate a condition of reciprocating compressor 10 based at least in part on one or more operating parameters. For example, processor 206 also calculates a condition of reciprocating compressor 10 based on the predefined range of operating parameter values. In one embodiment, processor 206 may include a processing unit, such as, without limitation, an integrated circuit (IC), an application specific integrated circuit (ASIC), a microcomputer, a programmable logic controller (PLC), and/or any other programmable circuit. Alternatively, processor 206 may include multiple processing units (e.g., in a multi-core configuration).

In the exemplary embodiment, processor 206 is programmed to calculate an operating parameter value of reciprocating compressor 10 based at least in part on a vibration signal that is received from vibration sensor 132 and a pressure signal that is received from pressure sensor 116. Processor 206 also compares the calculated operating parameter value to the predefined parameter value to determine if a condition of reciprocating compressor 10 is outside the predefined reciprocating compressor 10 condition range.

In the exemplary embodiment, protection system 22 also includes a control interface 208 that controls an operation of reciprocating compressor 10 based at least in part on a calculated condition of reciprocating compressor 10. In some embodiments, control interface 208 is coupled to one or more reciprocating compressor control devices 210, such as, for example, motor 46 (shown in FIG. 2).

In the exemplary embodiment, protection system 22 includes a sensor interface 212 that is coupled to at least one sensor 24 such as, for example, position sensor 56, pressure sensor 116, and/or vibration sensor 132, for receiving signals from sensor 24. Each sensor 24 transmits a signal corresponding to a sensed operating parameter of reciprocating compressor 10. Moreover, each sensor 24 may transmit a signal continuously, periodically, or only once, for example, although, other signal timings are also contemplated. Furthermore, each sensor 24 may transmit a signal either in an analog form or in a digital form. Protection system 22 processes the signal(s) by processor 206 to create one or more operating parameters. In some embodiments, processor 206 is programmed (e.g., with executable instructions in memory area 204) to sample a signal produced by sensor 24. For example, processor 206 may receive a continuous signal from sensor 24 and, in response, periodically (e.g., once every five seconds) calculate a condition of reciprocating compressor 10 based on the continuous signal. In some embodiments, processor 206 normalizes a signal received from sensor 24. For example, sensor 24 may produce an analog signal with a parameter (e.g., voltage) that is directly proportional to an operating parameter value. Processor 206 may be programmed to convert the analog signal to the operating parameter. In one embodiment, sensor interface 212 includes an analog-to-digital converter that converts an analog voltage signal generated by sensor 24 to a multi-bit digital signal usable by protection system 22.

In the exemplary embodiment, protection system 22 includes a communication interface 214. Communication interface 214 is coupled in communication with one or more remote devices, such as user computing device 200. Communication interface 214 may transmit an operating parameter and/or a control parameter (e.g., a rotational velocity) to a remote device. For example, communication interface 214 may encode an operating parameter and/or a control parameter in a signal. In addition communication interface 214 receives the operating parameter and/or the control parameter from a remote device and controls an operation of reciprocating compressor 10 based at least in part on the received operating parameter and/or control parameter.

Various connections are available between control interface 208 and control device 210, and between sensor interface 212 and sensor 24. Such connections may include, without limitation, an electrical conductor, a low-level serial data connection, such as Recommended Standard (RS) 232 or RS-485, a high-level serial data connection, such as Universal Serial Bus (USB) or Institute of Electrical and Electronics Engineers (IEEE) 1394 (a/k/a FIREWIRE), a parallel data connection, such as IEEE 1284 or IEEE 488, a short-range wireless communication channel such as BLUETOOTH, and/or a private (e.g., inaccessible outside reciprocating compressor 10) network connection, whether wired or wireless.

Figure 5:
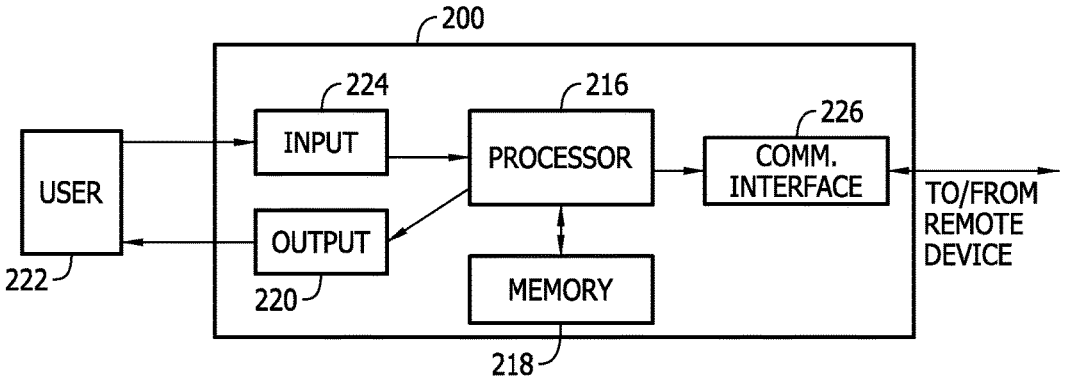

FIG. 5 is a block diagram of user computing device 200. In the exemplary embodiment, user computing device 200 includes a processor 216 for executing instructions. In some embodiments, executable instructions are stored in a memory area 218. Processor 216 may include one or more processing units (e.g., in a multi-core configuration). Memory area 218 is any device allowing information, such as executable instructions and/or other data, to be stored and retrieved.

User computing device 200 also includes at least one output component 220 for use in presenting information to a user 222. Output component 220 is any component capable of conveying information to user 222. Output component 220 may include, without limitation, a display device (e.g., a liquid crystal display (LCD), an organic light emitting diode (OLED) display, or an audio output device (e.g., a speaker or headphones).

In some embodiments, user computing device 200 includes an input component 224 for receiving input from user 222. Input component 224 may include, for example, a keyboard, a pointing device, a mouse, a stylus, a touch sensitive panel (e.g., a touch pad or a touch screen), a gyroscope, an accelerometer, a position detector, and/or an audio input device. A single component, such as a touch screen, may function as both an output device of output component 220 and input component 224. User computing device 200 also includes a communication interface 226, which is communicatively coupled to network 202 and/or protection system 22.

During operation of reciprocating compressor 10, protection system 22 receives signals indicative of a rotational position of crankshaft 44 from position sensor 56. Protection system 22 calculates crank angle $\alpha$ based at least in part the rotational position of crankshaft 44. In the exemplary embodiment, protection system 22 calculates crank angle $\alpha$ at 0.5° intervals. Alternatively, protection system 22 calculates crank angle $\alpha$ at any suitable interval sufficient to enable condition monitoring system 12 to function as described herein.

In the exemplary embodiment, protection system 22 receives signals indicative of a pressure of fluid within cylinder head 92 from pressure sensor 116. Protection system 22 calculates gas force 130 acting upon piston head 58 based at least in part on the received signals from pressure sensor 116. In one embodiment, protection system 22 calculates the gas force acting upon cylinder head 92 by multiplying the sensed pressure by working surface area 84 of piston head 58. In addition, protection system 22 calculates gas force 130 at each calculated crank angle $\alpha$.

In one embodiment, protection system 22 receives signals indicative of a pressure within HE chamber 104 from first pressure sensor 118, and calculates a gas force acting upon head end surface 80 of piston head 58 based at least in part on the received signals from first pressure sensor 118. In addition, protection system 22 receives signals indicative of a pressure within CE chamber 108 from second pressure sensor 120, and calculates a gas force acting upon crank end surface 78 of piston head 58 based at least in part on the received signals from first pressure sensor 118. In this embodiment, protection system 22 calculates gas force 130 by adding the calculated gas force acting upon crank end surface 78 and the gas force acting upon head end surface 80.

In the exemplary embodiment, protection system 22 receives signals indicative of an acceleration of cylinder assembly 26 along centerline axis 68 from vibration sensor 132. Protection system 22 calculates a displacement value of cylinder assembly 26 along centerline axis 68 based at least in part on the sensed acceleration of cylinder assembly 26.

In addition, protection system 22 calculates the displacement value of cylinder assembly 26 at each calculated crank angle α.

In one embodiment, protection system 22 receives signals indicative of an acceleration of reciprocating compressor 10 along centerline axis 68 from first vibration sensor 134, and receives signals indicative of an acceleration of compressor frame 28 along centerline axis 68 from second vibration sensor 136. Protection system 22 calculates a displacement value of cylinder assembly 26 along centerline axis 68 based at least in part on the sensed acceleration of reciprocating compressor 10 and the sensed acceleration of compressor frame 28. More specifically, protection system 22 calculates the displacement value of cylinder assembly 26 based at least in part on the difference between the sensed acceleration of reciprocating compressor 10 and the sensed acceleration of compressor frame 28. In addition, protection system 22 calculates the displacement value of cylinder assembly 26 at each calculated crank angle α.

In the exemplary embodiment, protection system 22 determines that a condition of reciprocating compressor 10 is less than a predefined reciprocating compressor condition, after determining that the calculated parameter value of cylinder assembly 26 is different than a predefined parameter value. Protection system 22 also transmits a notification signal to user computing device 200 after determining that a monitored condition of reciprocating compressor is less than a predefined reciprocating compressor condition. User computing device 200 displays a notification to user 222 with communication interface 214 after receiving the notification signal from protection system 22. In one embodiment, protection system 22 operates motor 46 to modulate a rotational velocity of crankshaft 44 after determining that the calculated parameter value of cylinder assembly 26 is different than a predefined parameter value. In another alternative embodiment, protection system 22 operates motor 46 to shut-down an operation of reciprocating compressor 10 after determining that the calculated parameter value of cylinder assembly 26 is different than a predefined parameter value.

In an alternative embodiment, protection system 22 calculates a first gas force acting upon cylinder head 92 at a calculated first crank angle α in a first compressor operation cycle. Protection system 22 also calculates a first displacement value of cylinder assembly 26 at the first calculated crank angle α in the first compressor operation cycle.

In one embodiment, protection system 22 calculates a range of gas force values acting upon cylinder head 92 in a first complete compressor operation cycle. Protection system 22 also calculates an array of gas force values based at least in part on the calculated range of gas force values. Protection system 22 calculates a range of displacement values of cylinder assembly 26 in the first complete compressor operation cycle. Protection system 22 also calculates an array of displacement values based at least in part on the calculated range of displacement values.

In another alternative embodiment, protection system 22 calculates an array range of gas force values acting upon cylinder head 92 at a plurality of calculated crank angles. Protection system 22 also calculates an array of displacement values of cylinder assembly 26 the plurality of calculated crank angles. In this embodiment, protection system 22 calculate an array of parameter values within a predefined range of calculated crank angles based at least in part on the calculated array of gas force values divided by the calculated array of displacement values.

Figure 6:
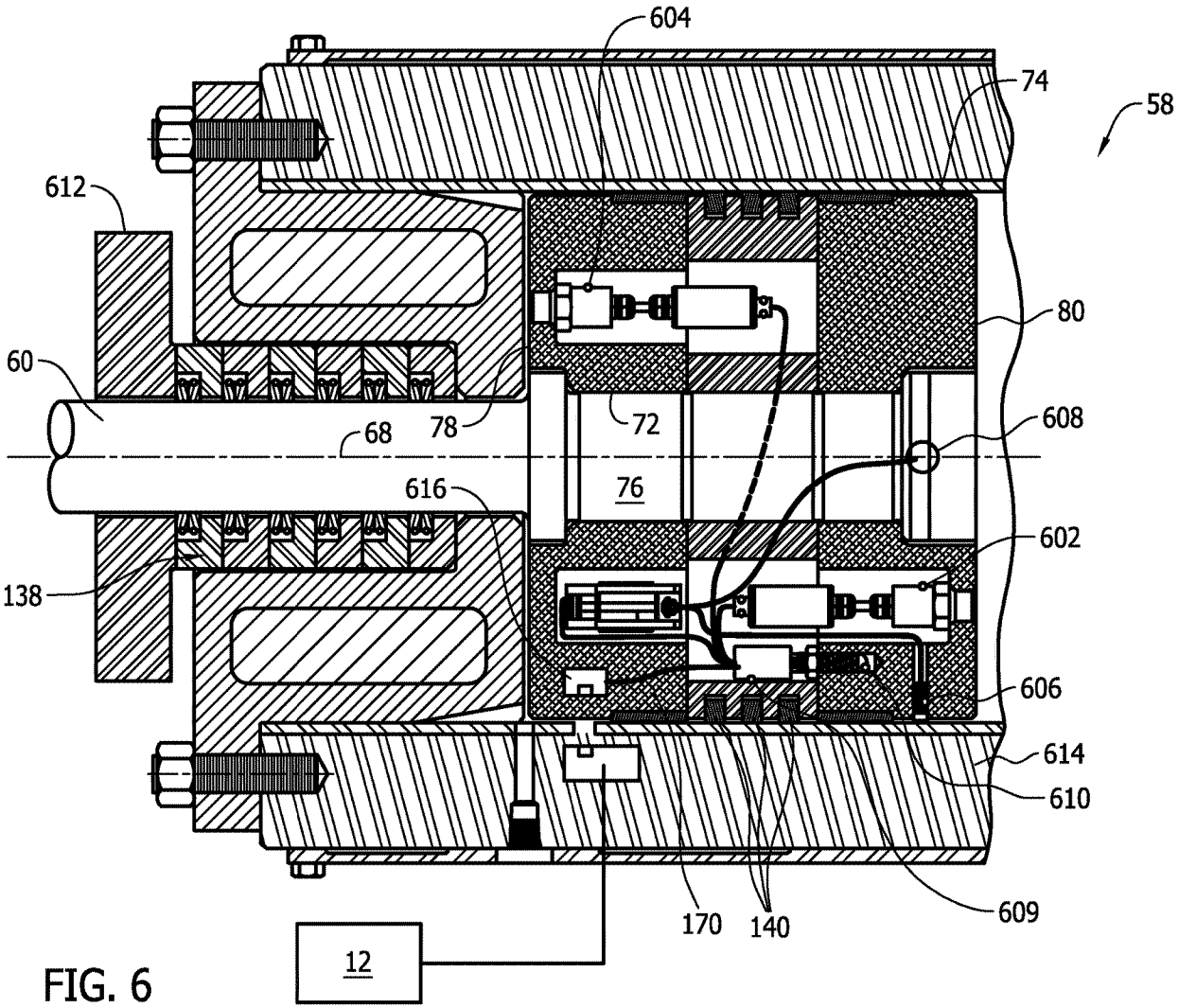

FIG. 6 is a cross-sectional view of piston head 58 in accordance with an example embodiment of the present disclosure. In the example embodiment, piston head 58 includes a head end pressure transducer 602, a crank end pressure transducer 604, a first proximity probe 606, a second proximity probe 608 displaced circumferentially about piston head 58 approximately 90° from first proximity probe 606 and a linear alternator 609 and phase reference sensor 610. Piston head 58 includes two pressure transducers, 602 and 604, one for each face 80 and 78, respectively to permit capturing both the crank end and head end pressure curves.

In some embodiments, proximity probes, 606 and/or 608, are positioned within piston head 58 in either a single or an orthogonal configuration. Displacement readings provided by proximity probes, 606 and 608 are used to determine a position of piston head 58 inside cylinder head 92. This allows a rider band thickness to be measured directly. Additional probe(s) could be installed in a second plane to measure a tilt of piston head 58 relative to inner surface 98 of cylinder head 92.

In various other embodiments, proximity probes are mounted to piston head 58 and viewing a piston rod collar 612 to detect piston head 58 axial motion relative to piston rod 60. This would be an indication of a loose piston. Other embodiments include seismic (gyro and/or acceleration) sensors mounted to piston rod 60 and/or a wall 614 of cylinder head 92. The readings from these sensors can be combined with the instrumentation onboard the piston to provide additional measurements. Additionally, signals from other sensors 24 (i.e. piston rod vibration, crosshead acceleration, etc.) can be integrated with signals from the piston head instrumentation to provide additional measurements and/or equipment health information. For example, condition monitoring system 12 is configured to integrate measurements of operating parameters acquired by sensors 24 positioned within piston head body 70 with measurements of operating parameters acquired by sensors 24 positioned offboard piston head body 70 to at least one of validate measurements between sensors, generate virtual measurements of parameters not directly measured using sensors, and provide compressor health information. Moreover, in some embodiments, sensors 24 include one or more ultrasonic or acoustic emission sensors positioned proximate pressure rings 140 and configured to detect leakage past rings 140. Optionally, one or more uni- or tri-axial accelerometers are positioned within piston head body 70 to facilitate determining piston hop and/or mechanical looseness in reciprocating compressor 10. Also, optionally, fast response temperature elements are positioned within piston head body 70 at each of crank end surface 78 and head end surface 80 to measure pressure chamber temperature.

A linear alternator 609 provides both power and can be used as a phase reference sensor. This ensures that data collected will be synchronous to piston motion. Alternative linear generators include mounting a magnet or magnetizing a part of the cylinder bore or cylinder head and mounting a multi turn coil into piston head body 70. In various embodiments, power source 609 includes storage capacitors, such as, super-capacitors, batteries and/or inductive power. Additionally, batteries may be used with any generator or alternator positioned onboard piston head body 70 to, for example, provide power to sensors and transceivers positioned onboard piston head body 70 during shutdown periods and/or during a startup or shutdown when an electrical generator may not have sufficient motion to generate enough electrical power to supply all components onboard piston head body 70.

Alternator 609 is electrically coupled to a signal conditioning and transceiver electronics device 616. Signal transfer from signal conditioning and transceiver electronics device 616, positioned within piston head body 70, to a complementary transceiver 618, positioned within or proximate wall 614 of cylinder head 92 is performed in real time through a continuous wireless connection or performed intermittently. In intermittent operation, signal conditioning and transceiver electronics device 616 transmits during a predetermined portion a piston stroke, such as, at an end of a stroke or mid stroke. Signal conditioning and transceiver electronics device 616 is configured to send the signal for the entire revolution through RF, inductive, or capacitive means. Alternative phase reference sensors can include an additional proximity probe measuring a feature of the cylinder bore such as the distance to the head end or crank end cylinder head or one of the machined openings for valve passages.

Figure 7:
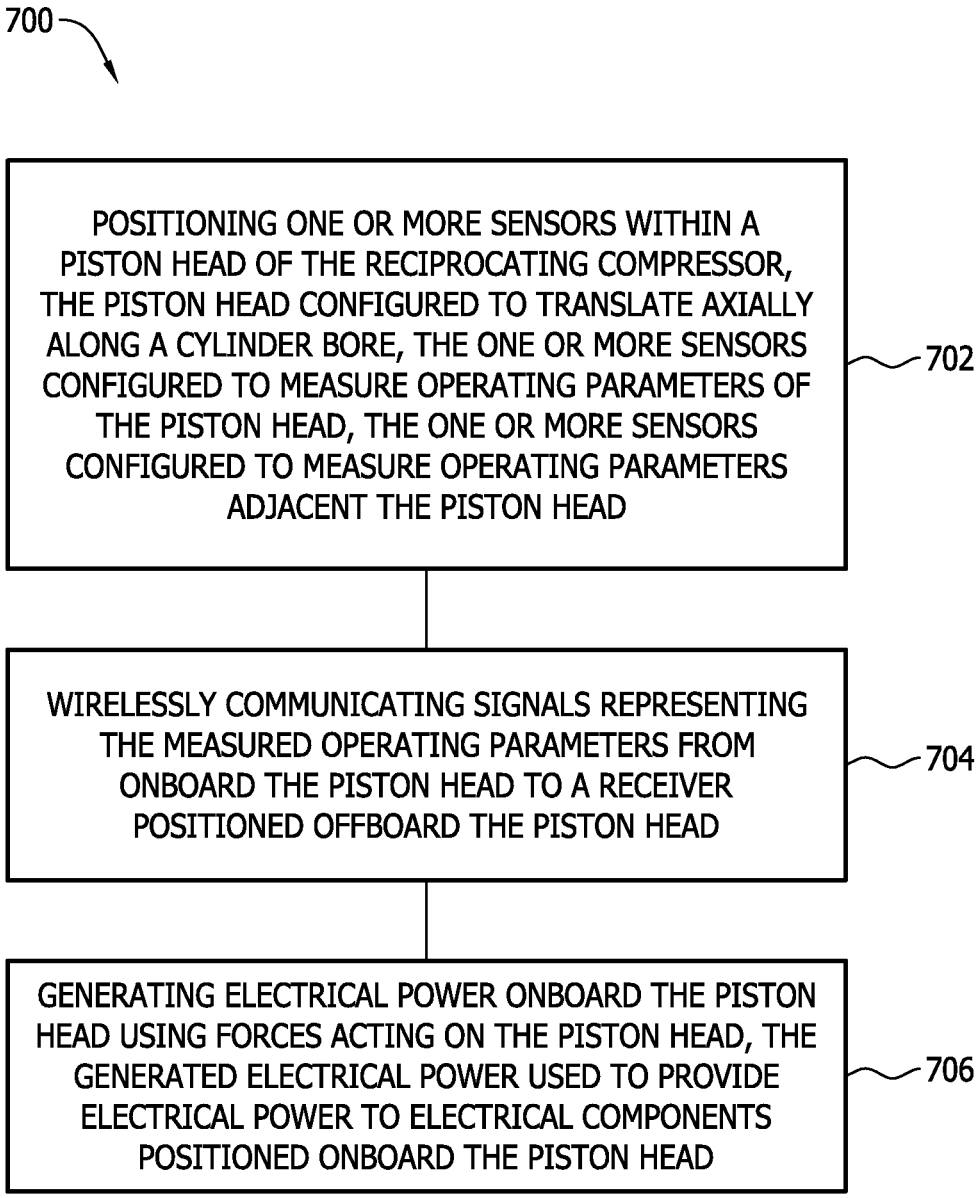

FIG. 7 is a flowchart of a method 700 of monitoring operating parameters of a reciprocating compressor. In the example embodiment, method 700 includes positioning 702 one or more sensors within a piston head of the reciprocating compressor wherein the piston head is configured to translate axially along a cylinder bore. The one or more sensors are configured to measure operating parameters of the piston head, and the one or more sensors are configured to measure operating parameters adjacent the piston head. Method 700 also includes wirelessly communicating 704 signals representing the measured operating parameters from onboard the piston head to a receiver positioned offboard the piston head. Method 700 further includes generating 706 electrical power onboard the piston head using forces acting on the piston head wherein the generated electrical power is used to provide electrical power to electrical components positioned onboard the piston head. Method 700 optionally includes integrating measurements of operating parameters acquired by the one or more sensors positioned within the piston head with measurements of operating parameters acquired by a plurality of sensors positioned offboard the piston head using a condition monitoring system associated with the reciprocating compressor. Method 700 also optionally includes at least one of validating measurements between sensors, generating virtual measurements of parameters not directly measured using the sensors, and providing compressor health information based on the integrated measurements.

The foregoing detailed description illustrates embodiments of the disclosure by way of example and not by way of limitation. It is contemplated that the disclosure has general application to the review and revision of advertisements. It is further contemplated that the methods and systems described herein may be incorporated into existing online advertising planning systems, in addition to being maintained as a separate stand-alone application.

The above-described embodiments of a method and system of instrumenting a piston head of a reciprocating compressor provides a cost-effective and reliable means for monitoring reciprocating compressor parameters during operation. More specifically, the methods and systems described herein facilitate powering the instrumentation using a self-contained power generator positioned onboard the piston. In addition, the above-described methods and systems facilitate communicating the measured parameters to a monitoring and/or protection system positioned offboard the piston. As a result, the methods and systems described herein facilitate automatically monitoring reciprocating compressor parameters in a cost-effective and reliable manner.

Because the piston can be retrofit with the instrumentation during a machine overhaul in a shop environment and then installed in the reciprocating compressor in the field, the methods and apparatus described herein greatly reduces the installation cost for transducers. Including the instrumentation probes onboard each piston also provides a way to capture true rider band wear.

Example methods and apparatus for automatically and continuously monitoring reciprocating compressor operating parameters are described above in detail. The apparatus illustrated is not limited to the specific embodiments described herein, but rather, components of each may be utilized independently and separately from other components described herein. Each system component can also be used in combination with other system components.

This written description uses examples to describe the disclosure, including the best mode, and also to enable any person skilled in the art to practice the disclosure, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A piston head assembly comprising:

a piston head body including an interior cavity offset from a longitudinal axis of the piston head body;

at least one sensor positioned within the piston head body and coupled to a battery configured to supply the at least one sensor with electrical energy in response to the piston head body being not in motion; and an electrical power source positioned within the interior cavity of the piston head body, the electrical power source including a linear power generator and a phase reference sensor, the linear power generator coupled to the at least one sensor and configured to provide electrical energy to the at least one sensor in response to the piston head body being in motion, and the phase reference sensor configured to facilitate synchronizing measured parameter values with piston head body motion.

2. The piston head assembly of claim 1, wherein the linear power generator is configured to generate electrical energy from forces acting on said piston head body.

3. The piston head assembly of claim 1, wherein said electrical power source includes at least one of a storage capacitor and the battery.

4. The piston head assembly of claim 1, further comprising a transceiver positioned within said piston head body, said transceiver configured to receive signals representing measured parameter values from said at least one sensor, said transceiver configured to transmit one or more messages including the received signals onboard the piston head body.

5. The piston head assembly of claim 1, wherein said at least one sensor comprises a first proximity probe orthogonally aligned with respect to a face of said piston head body.

6. The piston head assembly of claim 5, wherein said at least one sensor includes a second proximity probe orthogonally aligned with respect to a face of said piston head body and spaced circumferentially approximately 90° from said first proximity probe.

7. The piston head assembly of claim 6, wherein an output of at least one of said first proximity probe and said second proximity probe is configured to provide phase reference sensor information.

8. The piston head assembly of claim 6, further comprising a third proximity probe positioned within said piston head body, said third proximity probe configured to provide phase reference sensor information.

9. The piston head assembly of claim 1, wherein said at least one sensor comprises a first pressure transducer configured to measure a pressure at a crank end of said piston head body.

10. The piston head assembly of claim 9, wherein said at least one sensor comprises a second pressure transducer configured to measure a pressure at a head end of said piston head body.

11. The piston head assembly of claim 1, wherein said at least one sensor comprises at least one of an ultrasonic and an acoustic emission sensor positioned within said piston head body proximate pressure rings at least partially circumscribing said piston head body and configured to detect leakage past said pressure rings.

12. The piston head assembly of claim 1, wherein said at least one sensor comprises at least one of a single axis and multi-axial accelerometers positioned within said piston head body and configured to detect at least one of piston hop and mechanical looseness.

13. The piston head assembly of claim 1, wherein said at least one sensor comprises a temperature measuring element positioned within said piston head body and configured to detect at least one of a head end chamber temperature and a crank end chamber temperature.

14. The piston head assembly of claim 1, wherein the piston head assembly is double-acting.

15. A control system for a reciprocating compressor comprising:

a plurality of sensors positioned within a piston head body of said reciprocating compressor, the piston head body including an interior cavity offset from a longitudinal axis of the piston head body, the plurality of sensors coupled to a battery configured to supply electrical power to the plurality of sensors in response to the piston head body being not in motion; and a power supply including a linear alternator and a phase reference sensor positioned within the interior cavity of said piston head body, the linear alternator configured to generate electrical power using forces acting on said piston head body, said power supply electrically coupled to said plurality of sensors, and the phase reference sensor configured to facilitate synchronizing measured parameter values with piston head body motion.

16. The control system of claim 15, further comprising a signal transceiver positioned within said piston head body and configured to communicate signals from said plurality of sensors to a complementary signal transceiver positioned offboard said piston head body.

17. The control system of claim 16, wherein said complementary signal transceiver is communicatively coupled to a condition monitoring system associated with said reciprocating compressor.

18. The control system of claim 17, further comprising a plurality of sensors positioned offboard said piston head body, said condition monitoring system configured to integrate measurements of operating parameters acquired by said plurality of sensors positioned within said piston head body with measurements of operating parameters acquired by said plurality of sensors positioned offboard said piston head body to at least one of validate measurements between sensors, generate virtual measurements of parameters not directly measured using sensors, and provide compressor health information.

19. A method of monitoring operating parameters of a reciprocating compressor, said method comprising:

positioning one or more sensors within a piston head body of the reciprocating compressor, the piston head body including an interior cavity offset from a longitudinal axis of the piston head body and configured to translate axially along a cylinder bore, the one or more sensors configured to measure operating parameters of the piston head body, the one or more sensors configured to measure operating parameters adjacent the piston head body;

wirelessly communicating signals representing the measured operating parameters from onboard the piston head body to a receiver positioned offboard the piston head body;

supplying electrical power from a battery to the one or more sensors in response to the piston head body being not in motion; and generating the electrical power onboard the piston head body using forces acting on the piston head body and a power supply positioned within the interior cavity, the power supply including a linear power generator and a phase reference sensor, the linear power generator coupled to the one or more sensors and configured to provide the electrical power to the one or more sensors in response to the piston head body being in motion, and the phase reference sensor configured to facilitate synchronizing measured parameter values with piston head body motion.

20. The method of claim 19, further comprising:

integrating measurements of operating parameters acquired by the one or more sensors positioned within the piston head body with measurements of operating parameters acquired by a plurality of sensors positioned offboard the piston head body using a condition monitoring system associated with the reciprocating compressor; and at least one of validating measurements between sensors, generating virtual measurements of parameters not directly measured using the sensors, and providing compressor health information based in the integrated measurements.

* * * * *